US011332220B2

(12) United States Patent
Cergol

(10) Patent No.: US 11,332,220 B2
(45) Date of Patent: May 17, 2022

(54) BATHROOM FOR TWO CABINS OF A SHIP AND A STRUCTURE FOR TWO CABINS OF A SHIP COMPRISING THIS BATHROOM

(71) Applicant: FINCANTIERI S.p.A., Trieste (IT)

(72) Inventor: Maurizio Cergol, Trieste (IT)

(73) Assignee: FINCANTIERI S.P.A., Trieste (IT)

( * ) Notice: Subject to any disclaimer, the term of this patent is extended or adjusted under 35 U.S.C. 154(b) by 132 days.

(21) Appl. No.: 16/944,530

(22) Filed: Jul. 31, 2020

(65) Prior Publication Data

US 2021/0031884 A1 Feb. 4, 2021

(30) Foreign Application Priority Data

Aug. 1, 2019 (IT) ..... 102019000013635

(51) Int. Cl.
*B63B 29/14* (2006.01)

(52) U.S. Cl.
CPC ..... *B63B 29/14* (2013.01)

(58) Field of Classification Search
CPC ..... B63B 29/00; B63B 29/02; B63B 29/025; B63B 29/027; B63B 29/14; B63B 2029/145
USPC ..... 114/65 R, 71, 77 R, 77 A, 78
See application file for complete search history.

(56) References Cited

U.S. PATENT DOCUMENTS 6,016,636 A * 1/2000 Caputo ..... B63B 29/025 114/189
10,745,088 B2 * 8/2020 Llago Hermida ..... E04B 1/24

FOREIGN PATENT DOCUMENTS

| | | |
|---|---|---|
| DE | 445157 C | 6/1927 |
| DE | 4005902 A1 | 8/1991 |
| WO | 9406663 A1 | 3/1994 |

OTHER PUBLICATIONS

Search Report for corresponding Italian Application 201900013653, dated Mar. 9, 2020, 2 pages.

* cited by examiner

*Primary Examiner* — Daniel V Venne
(74) *Attorney, Agent, or Firm* — Armstrong Teasdale LLP

(57) ABSTRACT

A bathroom for two cabins of a ship is provided, the bathroom including three spaces and two separate entrances for access to the bathroom from the two cabins. The three spaces include a first room, a second room, and a shower room that is accessible from the first room and from the second room. The shower room includes a movable wall, which is movable between two positions: (i) a first position in which the movable wall forms a separation wall between the first room and the shower room and allows access to the shower room from the second room, and (ii) a second position in which the movable wall forms a separation wall between the second room and the shower room and allows access to the shower room from the first room.

16 Claims, 8 Drawing Sheets

BATHROOM FOR TWO CABINS OF A SHIP AND A STRUCTURE FOR TWO CABINS OF A SHIP COMPRISING THIS BATHROOM

CROSS-REFERENCE TO RELATED APPLICATIONS

This application claims the benefit of priority to Italian Patent Application No. 102019000013635, filed on Aug. 1, 2019, the entire contents and disclosure of which are hereby incorporated by reference herein.

FIELD OF APPLICATION

The present invention relates to a bathroom for two cabins of a ship and to a prefabricated structure for two cabins of a ship comprising this bathroom.

PRIOR ART

As is known, the areas of a ship intended for accommodating the crew have to take up the smallest possible percentage of the available areas, thus benefitting the areas intended for the passengers.

But while there is this need, there is also the need to make the accommodation intended for the crew living on-board the ship, including for long periods of time, for example a few months, both comfortable and cozy.

Of course, the need to have comfortable spaces for the crew clashes with the need for the areas intended for the crew to occupy a small percentage.

The prior art has addressed these problems by providing a first type of cabin, which is intended for two people and shares the bathroom with another cabin intended for another two people.

This solution, which provides shared rooms and a bathroom shared by four people, is obviously not adapted for ensuring high levels of comfort and hygiene that should, however, be guaranteed for the crew.

An improvement with respect to this type of accommodation is represented by accommodation intended for just one person that shares the bathroom with another piece of accommodation. In this solution, the living comfort of the accommodation is improved, but two members of crew are forced to share the bathroom.

This type of accommodation is used the most since it provides individual sleeping areas, which are separate and accessible from two separate entrances, but with an entirely communal bathroom that is accessible from inside the sleeping areas. The main disadvantage of this type of accommodation is that two members of crew have to take it in turns to use the bathroom.

One type of cabin is known and used that is similar to the previous cabin, in which each piece of accommodation also has a washbasin.

Although this last solution represents a further improvement in terms of the comfort and hygiene of the accommodation intended for the crew, it still has a few drawbacks in terms of, for example, sharing the sanitary vase between two members of crew.

Furthermore, in this solution, the washbasin is located in the cabin, adjacently to the desk. Therefore, in addition to not ensuring a level of hygiene, it turns the washbasin into a sort of support shelf that is always damp. Furthermore, this solution makes it difficult to use the desk.

The solutions in the prior art have further drawbacks.

In fact, from the point of view of the plants for draining the bathroom, the fact of having a bathroom shared between two pieces of accommodation means that, for design and maintenance convenience, the plants for draining the shower, the washbasin (when communal) and the sanitary vase are arranged in a gap formed beneath the floor. Therefore, the level of the bathroom will consequently be lower than the level of the cabin.

Furthermore, the production units require the option to use as many prefabricated modules as possible, both because the construction of the modules is more simple and the construction times are shorter on land, and in order to render the supplies, the components and the plants as uniform as possible and to standardize them as far as possible.

PRESENTATION OF THE INVENTION

There is therefore the need to overcome the drawbacks and limitations cited with reference to the prior art.

Therefore, there is the need to provide a bathroom for two cabins, which is more comfortable that the types of bathrooms in the prior art.

Furthermore, there is the need to increase the level of hygiene of the bathroom compared with the solutions in the prior art.

Once again, another need is to provide a sanitary vase for the exclusive use of each cabin.

Furthermore, there is the need to increase the level of privacy of the cabins intended for the crew.

Once again, there is the need to provide prefabricated modules for the cabins for the crew, which make it possible to decrease the production times of said cabins and make it possible to standardize as many parts of the structure of the cabins as possible.

These needs are met by a bathroom for two cabins of a ship as per claim 1, and by a structure for two cabins of a ship as per claim 13.

DESCRIPTION OF THE DRAWINGS

Additional features and the advantages of the present invention will become clearer from the description given below of preferred and non-limiting embodiments thereof, in which.

The elements or parts of elements that the embodiments described in the following have in common will be indicated by the same reference numerals.

DETAILED DESCRIPTION

Figure 1:
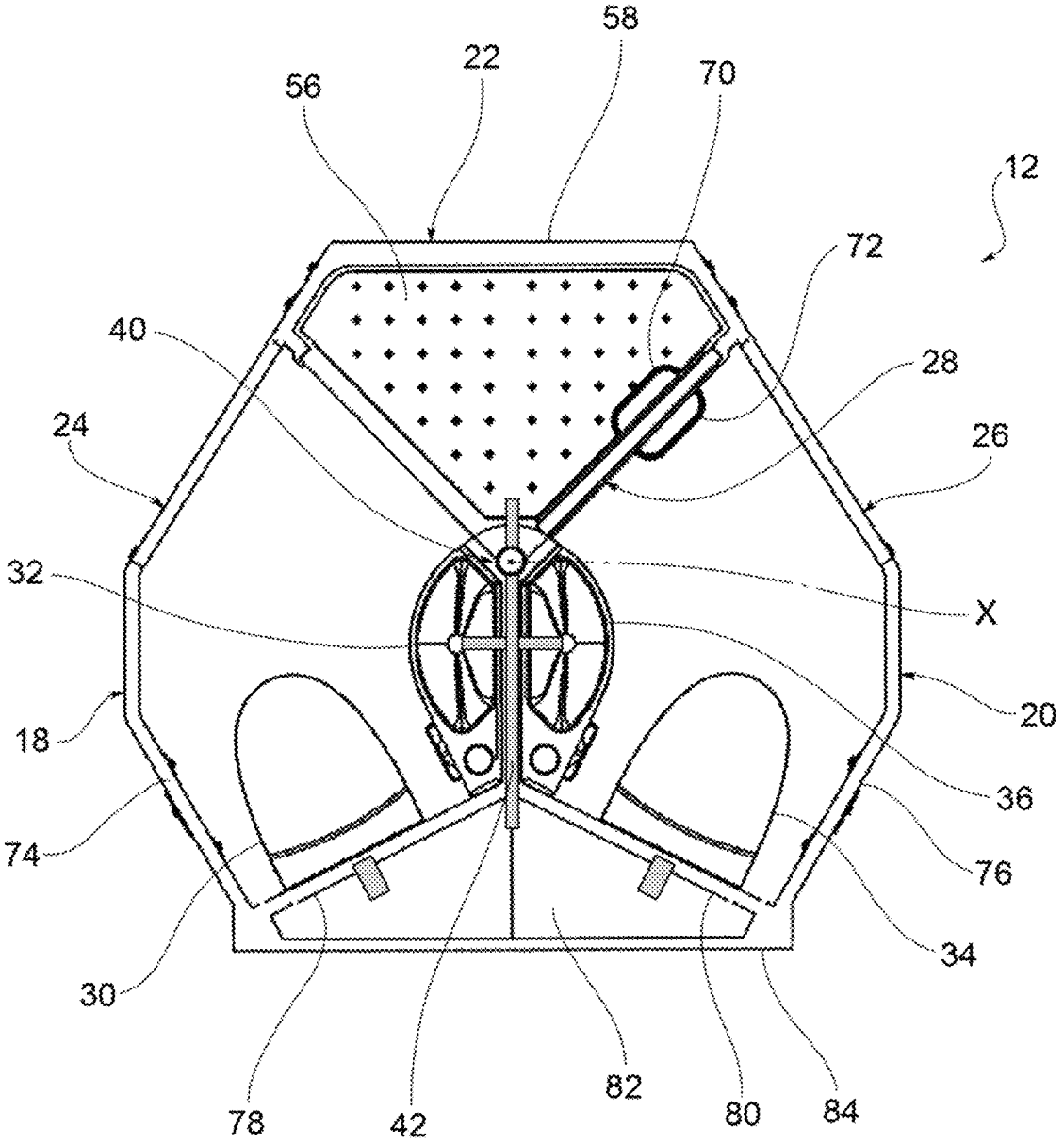
FIG. 1 schematically shows a plan view of a bathroom for two cabins of a ship as per the present invention in a first operating configuration.

In FIG. 1, general reference numeral 12 indicates a bathroom for two cabins 14, 16 of a ship as per the present invention.

The bathroom 12 essentially comprises three spaces 18, 20, 22 and two separate entrances 24, 26 for access to the bathroom from the respective two cabins 14, 16.

Figure 2:
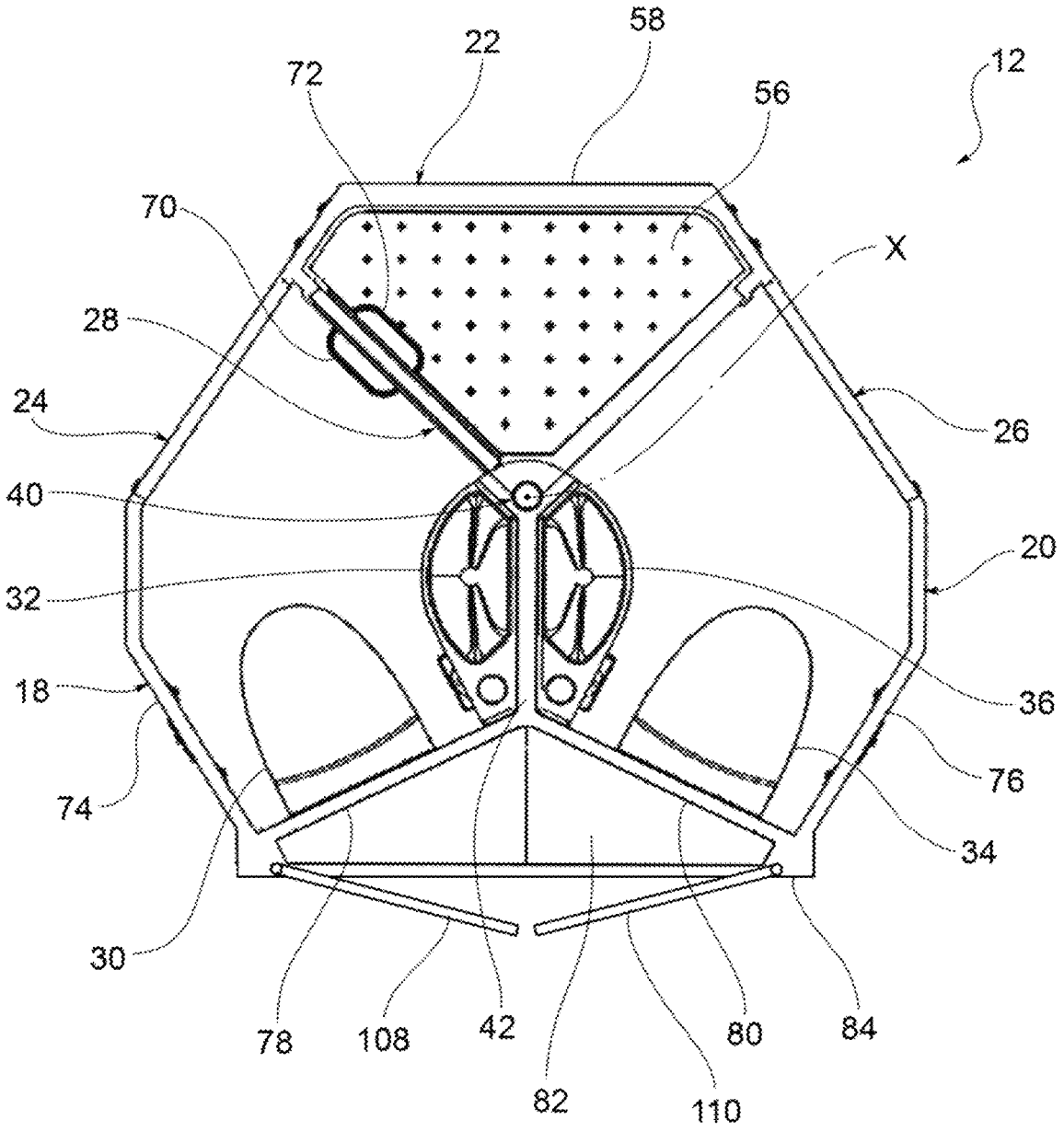
FIG. 2 schematically shows a plan view of a bathroom for two cabins of a ship according to the present invention in a second operating configuration.

As may be seen in the examples in FIGS. 1 and 2, the three spaces 18, 20, 22 comprise:

- a first room 18 and a second room 20; and
- a shower room 22 that is accessible from the first room 18 and from the second room 20.

The shower room 22 comprises a movable wall 28, which is adapted to be moved between two positions:

- a first position in which the movable wall 28 forms a separation wall between the first room 18 and said shower room 22 and allows access to the shower room 22 from the second room 20; and
- a second position in which the movable wall 28 forms a separation wall between the second room 20 and the shower room 22, and allows access to the shower room 22 from the first room 18.

As may be seen in FIGS. 1 and 2, the first room 18 may comprise a first sanitary vase 30 and a first washbasin 32 and the second room 20 may comprise a second sanitary vase 34 and a second washbasin 36.

In alternative embodiments of the bathroom, the first room 18 and the second room 20 may be provided with the washbasin or with the sanitary vase. In another embodiment, the first room 18 and the second room 20 may form antechambers for entry into the shower room, with the washbasin and sanitary vase arranged outside the first and the second room.

In accordance with a possible embodiment, the bathroom 12 comprises a central wall 42 between the first room 18 and the second room 20.

In other words, as may be seen in the example shown in FIGS. 1 and 2, the first room 18 and the second room 20 may be separated from one another by the central wall 42 and by the shower room 22.

In accordance with a possible embodiment, the central wall 42, the moveable wall 28 in the first position, and the moveable wall 28 in the second position may form a Y, in which the moveable wall 28 in the first position and in the second position forms the arms of the Y, while the central wall 42 forms the trunk of the Y.

In accordance with a possible embodiment, the moveable wall 28 may comprise a side edge 38 that is provided with hinge means 40 adapted to connect said moveable wall 28 to a central wall 42. The hinge means 40 are adapted to allow the moveable wall 28 to rotate about a hinge axis X between the first position and the second position.

Figure 3:
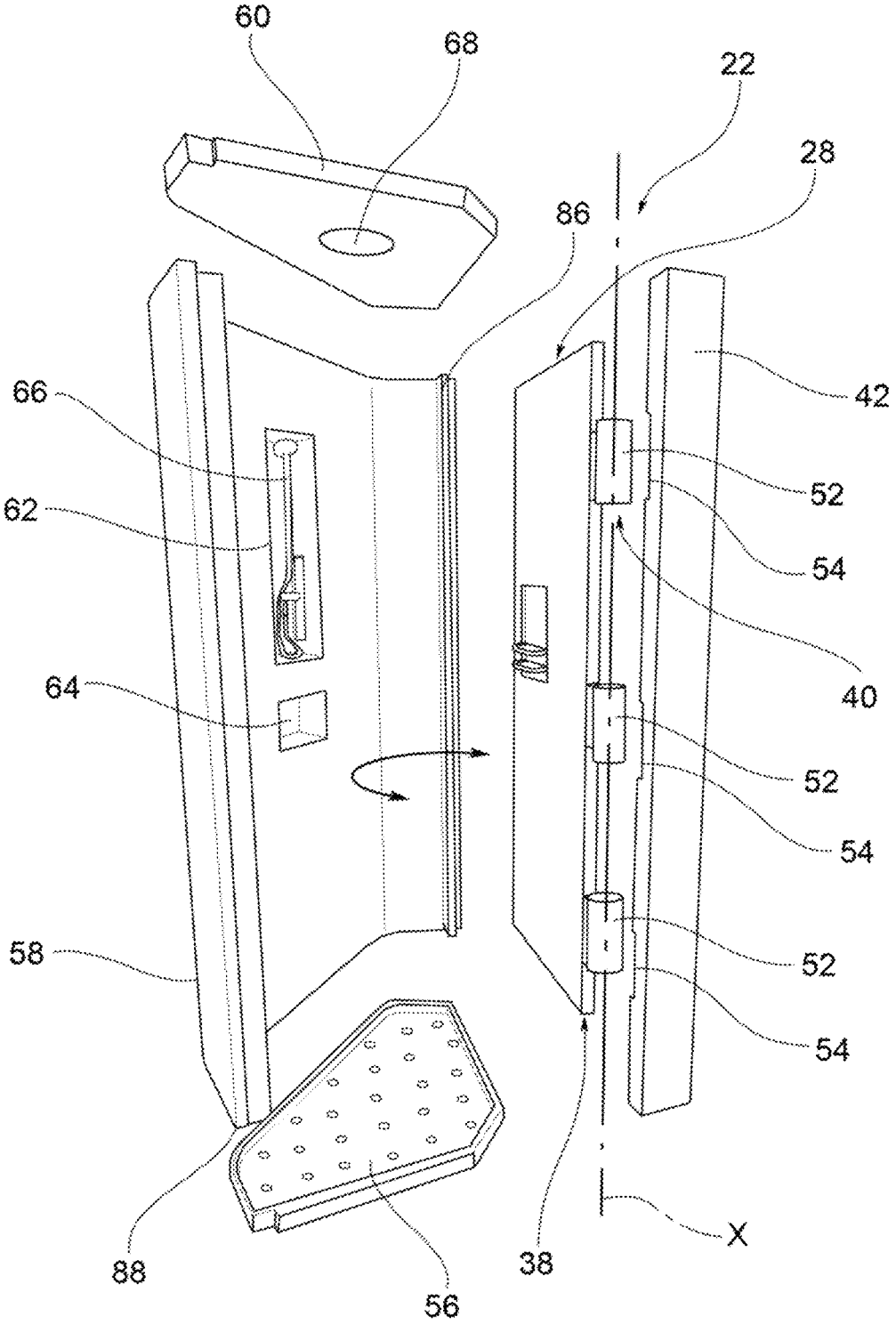
FIG. 3 schematically shows an exploded perspective view of a portion of a bathroom according to the present invention.
Figure 4:
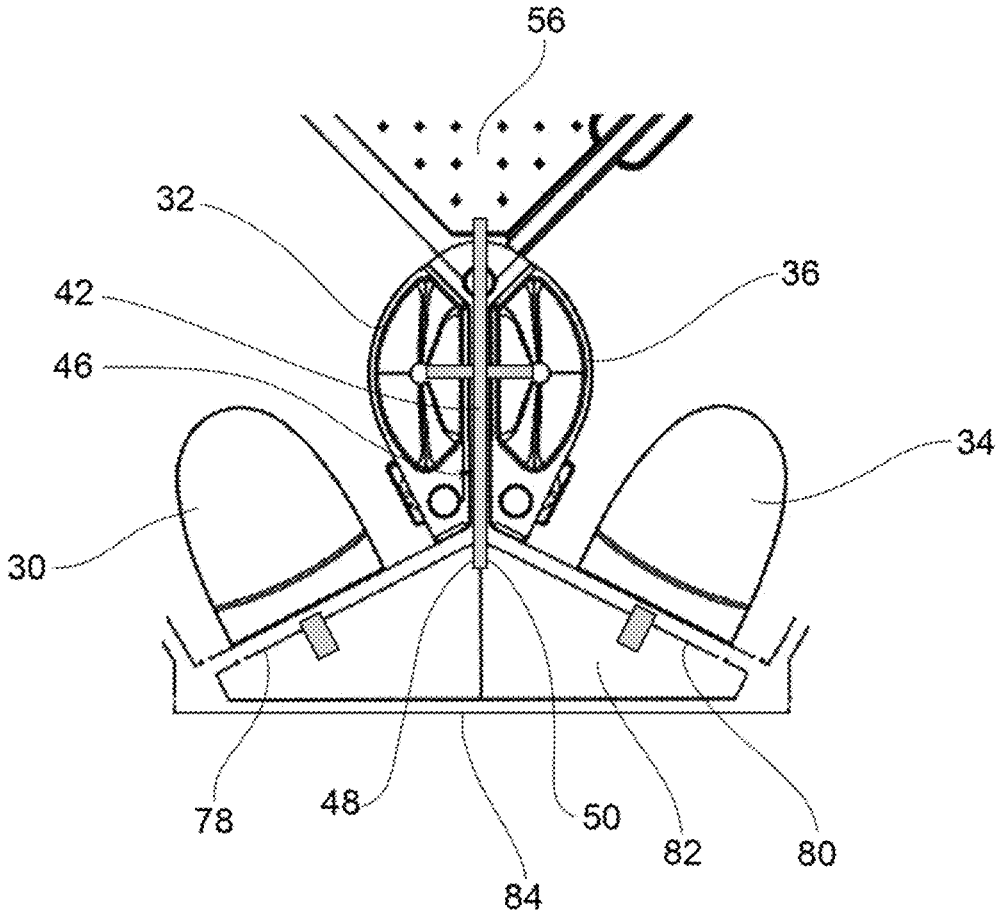
FIG. 4 schematically shows a plan view of a detail of FIG. 1.
Figure 5:
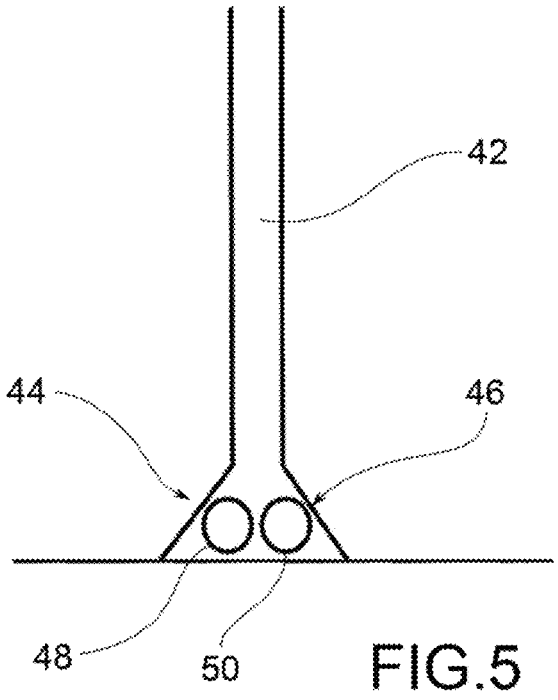
FIG. 5 schematically shows a sectional front view of a component of a bathroom according to the present invention.

FIG. 3 is a schematic view of a possible embodiment of the hinge means 40, in which three coupling cylinders 52 are arranged on the side edge 38 of the moveable wall 28, which may couple with respective seats 54 made in the central wall 42. In FIG. 3, the hinge axis X has been shown in the region of the coupling cylinders 52 for ease of reference.

In a possible alternative embodiment, which is not shown in the attached drawings, the moveable wall may be moved by means of the sliding guides arranged on the structure and relative sliding elements arranged on the wall.

In accordance with a possible embodiment, the moveable wall 28 may comprise a first handle 70 and a second handle 72, which are arranged on the opposite surfaces of the moveable wall 28.

As may be seen in the embodiment shown in FIG. 3, abutments 86, 88 may be provided, which may couple to the moveable wall 28 in order to prevent the movement of the moveable wall other than the first position and other than the second position.

In particular, the side wall 58 may comprise:

- a first abutment 86 that may prevent the movement of the moveable wall 28 beyond the first position inside the first room; and
- a second abutment 88 that may prevent the movement of the moveable wall 28 beyond the second position inside the second room.

In a possible alternative embodiment, the block may be directly formed by the hinge means 40.

With reference to FIG. 3, the shower room 22 may be a modular shower room that may be prefabricated and may comprise:

- a shower tray 56;
- a side wall 58; and
- a ceiling element 60.

As may be seen in FIG. 3, the side wall 58 may comprise one or more gaps 62, 64 in the surface that faces the inside of the shower room 22, in which gaps elements and/or components may be housed without interfering with the movement of the moveable wall 28.

In accordance with one embodiment, a first gap 62 may be provided, in which a showerhead 66 may be provided. Furthermore, a second gap 64 may be provided, in which a sponge and/or a bottle of shower gel may be positioned.

Lighting means 68, for example a LED lamp, may be arranged on the ceiling element 60.

In accordance with a possible embodiment, the moveable wall 28 is adapted to seal with the shower tray 56 and/or ceiling element 60 in the first position and in the second position.

In accordance with a possible embodiment, the central wall 42 between the first room 18 and the second room 20 is provided with the first washbasin 32 and the second washbasin 36.

One embodiment of this type is shown in the examples shown schematically in FIGS. 1, 2, 4 and 6.

In accordance with a possible embodiment, the central wall 42 comprises a technical compartment 46 near to the end 44 connected to the floor, inside which pipes 48, 50 for the shower room 22 and/or for the first and second washbasin 30, 36 are provided.

This design solution is particularly advantageous since it makes it possible to use the same technical compartment 46 for the pipes of the shower room 22 and for the pipes of the washbasins 32, 36.

In a possible alternative embodiment, the washbasins 32, 36 may be provided on side walls 74, 76 that are substantially opposite with respect to the shower room 22. One embodiment of this type is shown in the example in FIG. 7.

In accordance with a possible embodiment, two bottom walls may be provided opposite the shower room: a first bottom wall 78 relating to the first room 18 and second bottom wall 80 relating to the second room 20.

In a first embodiment, the first bottom wall 78 and the second bottom wall 80 may form a T together with the central wall 42. More specifically, the first bottom wall 78 and the second bottom wall 80 form the arms of the T, while the central wall 42 forms the trunk of the T.

Advantageously, the first sanitary vase 30 may be provided on the first bottom wall 78 and the second sanitary vase 34 may be provided on the second bottom wall 80.

FIGS. 1, 2, 4 and 6 show an alternative embodiment, in which the bottom walls 78, 80 are positioned differently.

In particular, the first bottom wall 78, the second bottom wall 80 and the central wall 42 may form a Y, in which: the first bottom wall 78 and the second bottom wall 80 form the arms of the Y, while the central wall 42 forms the trunk of the Y.

In accordance with a possible embodiment, a second technical compartment 82 may be provided in the first bottom wall 78 and the second bottom wall 80. The second technical compartment 82 may be formed in a space between the first bottom wall 78 and the second bottom wall 80 and the outer wall 84 of the bathroom 12.

Advantageously, the second technical compartment 82 may be used for the drainage pipes, electrical panels, etc.

Figure 7:
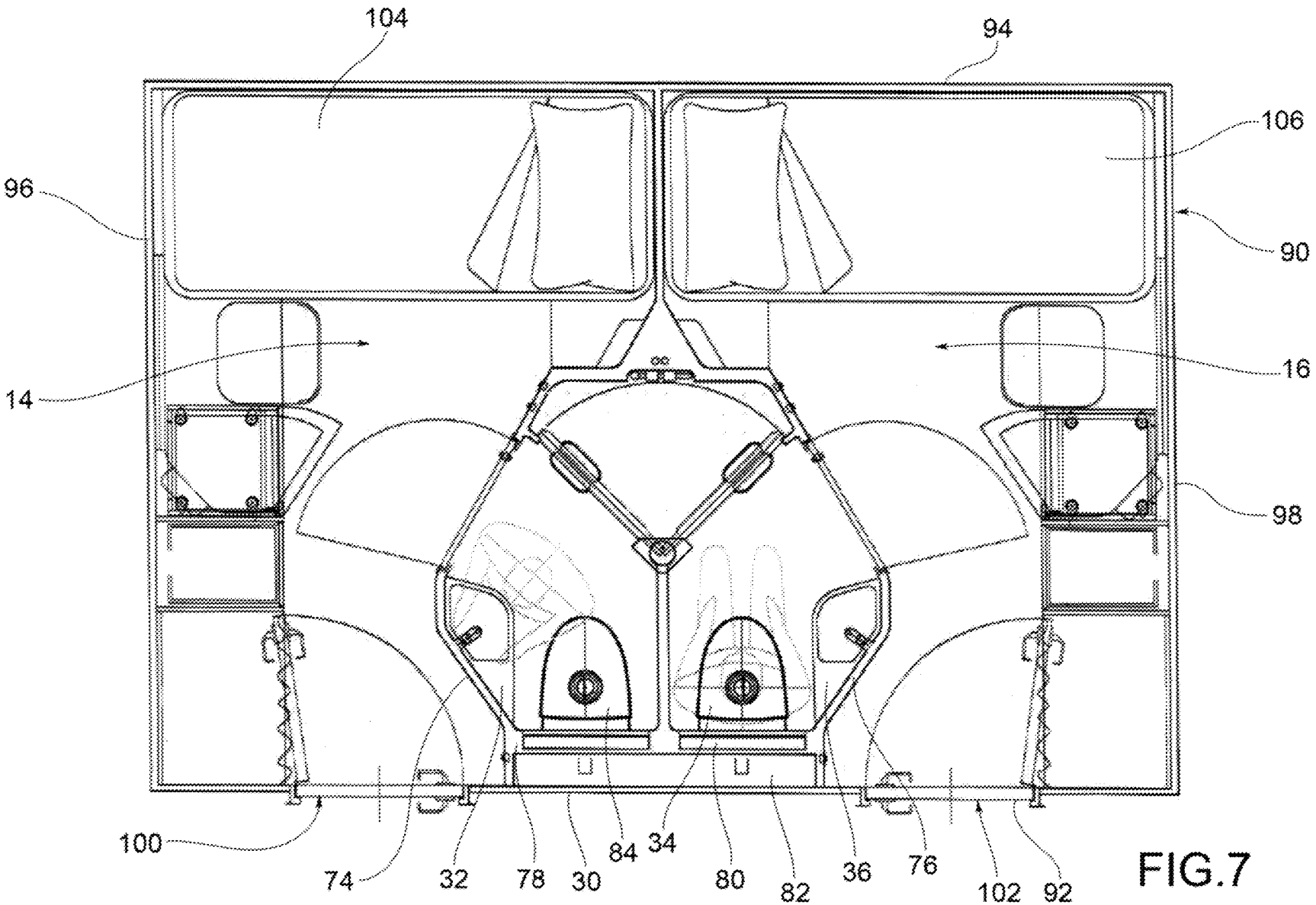
FIG. 7 schematically shows a plan view of an alternative embodiment of a structure for two cabins of a ship according to the present invention.

As may be seen in the embodiment shown in FIG. 7, the second technical compartment 82 may have a rectangular perimeter.

Figure 6:
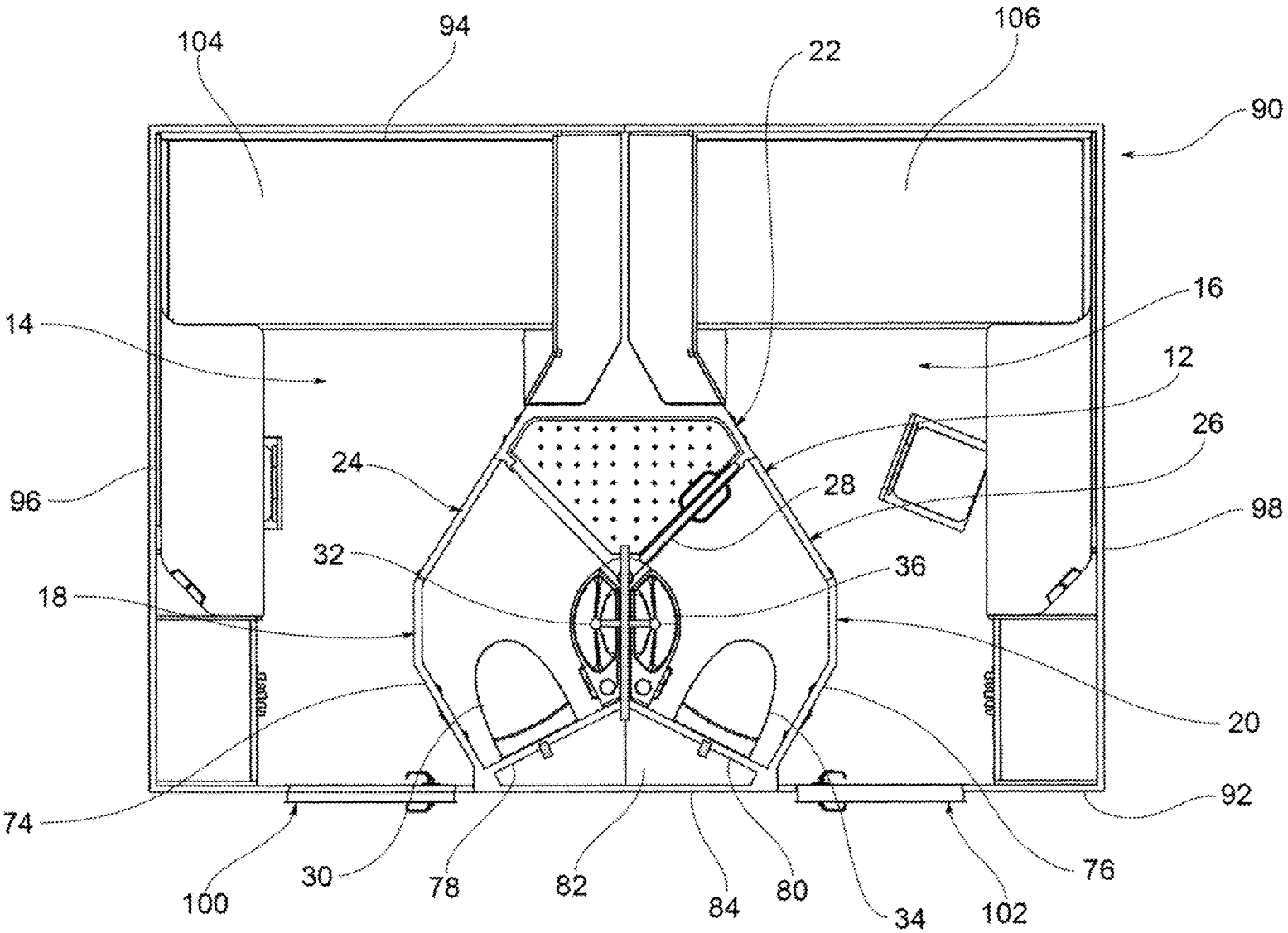
FIG. 6 schematically shows a plan view of a possible embodiment of a structure for two cabins of a ship as per the present invention.

Instead, as may be seen in the embodiment shown in FIG. 6, the second technical compartment 82 may have a triangular perimeter.

FIG. 2 shows a possible way of accessing the second technical compartment. In accordance with a possible embodiment, the second technical compartment may comprise at least one door 108, 110. The at least one door 108, 110 may be provided in a manner known per se with hinge means that open towards the outside of the bathroom. Advantageously, the at least one door 108, 110 may be accessible from outside of the cabin.

In accordance with a possible embodiment, the bathroom may have an outer perimeter having a substantially octagonal base.

Figure 8:
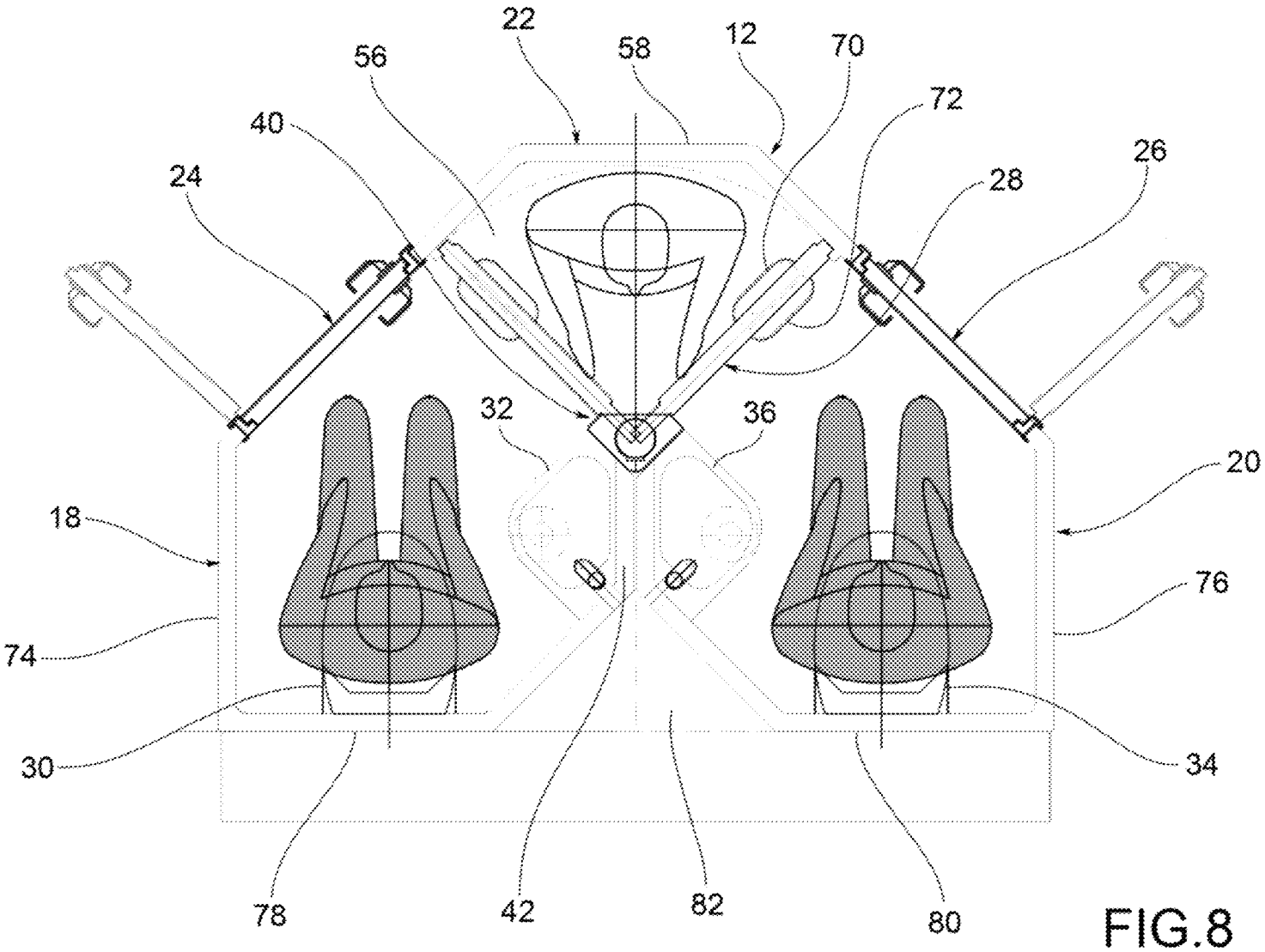
FIG. 8 schematically shows a plan view of a bathroom for two cabins of a ship as per a possible embodiment of the present invention.

FIG. 8 shows an alternative embodiment in which the bathroom may be provided with five sides.

Figure 9:
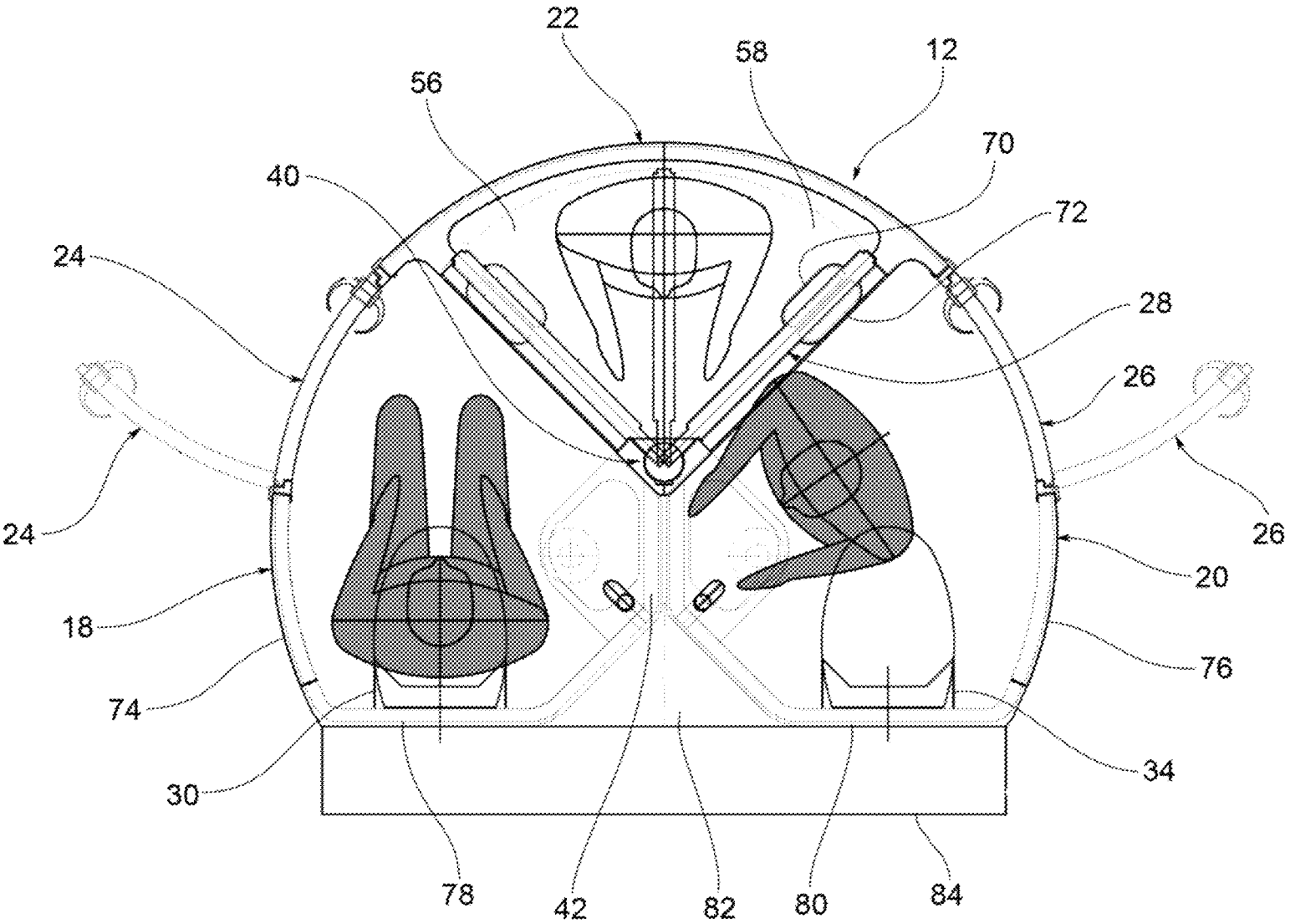
FIG. 9 schematically shows a plan view of a bathroom for two cabins of a ship according to a possible embodiment of the present invention.

FIG. 9 shows another embodiment, in which the bathroom is provided with a perimeter comprising a curved portion, for example having a circular shape, and an outer wall 84 in the region of the second technical compartment that is substantially formed by a rectilinear wall.

In accordance with a possible embodiment, the outer perimeter of the bathroom may also be a different type of perimeter formed by means of rectilinear and/or curved wall portions.

FIGS. 6 and 7 show two examples of structures 90 for two cabins according to the present invention.

In particular, the structure 90 for two cabins 14, 16 of a ship comprises a bathroom 12 for two cabins 14, 16 of the type described above.

More specifically, the structure comprises a first cabin 14 and a second cabin 16 in which the bathroom 12 is arranged in a substantially central position between the two cabins.

Therefore, the first room 18 is accessible from the first cabin 14, while the second room 20 is accessible from the second cabin 16.

Advantageously, the outer perimeter of the structure 90 may be substantially rectangular, comprising two major walls 92, 94 and two minor walls 96, 98.

In accordance with a possible embodiment, the bathroom 12 may be provided in the region of a major wall 92 of the outer perimeter of the structure 90 such that the outer wall 84 corresponds to a central portion of the major wall 92.

In accordance with a possible embodiment, the following may be arranged on the major wall 92 at the sides of the outer wall 84:

the first entrance 100 to the first cabin 14, and the second entrance 102 to the second cabin 16.

The first bed 104 and the second bed 106 may be arranged in the region of the second major wall 94. More specifically, the longer side of the first bed 104 and the second bed 106 is substantially stuck to the major wall 94 of the structure 90.

A separation wall between the two cabins may be arranged between the two beds.

Service elements, such as a desk, a television, a fridge, etc. may be arranged in the region of the minor walls 96, 98.

In accordance with a possible embodiment, the overall dimensions of the structure for two cabins may be defined by:

- a major wall 92, 94 having a length of between 4.00 meters and 4.20 meters; and
- a minor wall 96, 98 having a length of between 2.80 meters and 3.00 meters.

Advantageously, the overall dimensions of the structure for two cabins may be defined by:

- a major wall 92, 94 having a length of around 4.10 meters; and
- a minor wall 96, 98 having a length of around 2.91 meters.

In accordance with possible alternative embodiments, the outer perimeter of the structure 90 may be trapezoidal, or polygonal, for example. In another alternative embodiment, the outer perimeter 90 may be formed by means of rectilinear wall portions and/or curved wall portions.

The advantages that it is possible to achieve by means of a bathroom and a structure for two cabins of a ship according to the present invention are therefore now obvious.

First of all, a private sanitary vase is made available for each cabin. This constitutes an advantage in terms of both privacy and in terms of hygiene.

Furthermore, in the bathroom according to the present invention, only the shower room is shared between the two cabins. However, the specific movement and function of the moveable wall makes it possible to achieve a considerable improvement in terms of privacy.

Once again, the floor of the first room and the second room, in which the sanitary vases and the washbasins are arranged, is at the same level as the cabins, since the relative pipes may be arranged in a technical compartment 46 that is provided in the central wall 42.

In this regard, another advantage that is offered is a substantial reduction in the weight of the bathroom, and therefore of the cabin. In fact, since a compartment is no longer necessary beneath the floor of the bathroom for the passage of the pipes, the structure of the bathroom is significantly simplified in favor of mounting ease and the overall weight of the structure.

Furthermore, the bed may be positioned transversally with respect to the central wall between the two cabins such that the minor walls may house the items of furniture and functional elements.

In order to meet specific needs, a skilled person will be able to make modifications to the embodiments described above and/or substitute elements described with equivalent elements, without thereby departing from the scope of the attached claims.

The invention claimed is:

1. A bathroom for two cabins of a ship, the bathroom comprising three spaces, and two separate entrances for access to said bathroom from said two cabins, said three spaces comprising:

a first room; and a second room; and a shower room accessible from said first room and said second room, said shower room comprising a movable wall, said movable wall being movable between two positions including:

a first position wherein said movable wall creates a separation wall between said first room and said shower room, and allows access to said shower room from said second room; and a second position in which said movable wall creates a separation wall between said second room and said shower room, and allows access to said shower room from said first room.

2. The bathroom according to claim 1, wherein said first room comprises a first sanitary vase and a first washbasin, and said second room comprises a second sanitary vase and a second washbasin.

3. The bathroom according to claim 1, further comprising a central wall between said first room and said second room.

4. The bathroom according to claim 3, wherein said central wall, said movable wall in the first position, and said movable wall in the second position form a Y, wherein said movable wall in the first position and in the second position are arms of the Y, while said central wall is a trunk of the Y.

5. The bathroom according to claim 1, wherein said movable wall comprises a side edge that is provided with hinge means adapted to connect said movable wall to a central wall, said hinge means being adapted to allow the rotation of said movable wall around a hinge axis (X) between the first position and the second position.

6. The bathroom according to claim 3, wherein said first room comprises a first sanitary vase and a first washbasin, and said second room comprises a second sanitary vase and a second washbasin, and wherein on said central wall between said first room and said second room, said first washbasin and said second washbasin are arranged.

7. The bathroom according to claim 6, wherein said central wall, near an end connected to a floor, comprises a technical compartment inside which drainage pipes of at least one of said shower room said first and second washbasins are provided.

8. The bathroom according to claim 5, wherein said central wall, said movable wall in the first position, and said movable wall in the second position form a Y, wherein said movable wall in the first position and in the second position are arms of the Y, while said central wall is a trunk of the Y.

9. The bathroom according to claim 3, wherein, opposite said shower room, a first bottom wall relative to said first room, and a second bottom wall relative to said second room are arranged, wherein said first bottom wall, said second bottom wall and said central wall form a Y, wherein said first bottom wall and said second bottom wall are arms of the Y, while said central wall is a trunk of the Y.

10. The bathroom according to claim 9, wherein said first room comprises a first sanitary vase and a first washbasin, and said second room comprises a second sanitary vase and a second washbasin, and wherein said first sanitary vase is arranged at said first bottom wall and said second sanitary vase is arranged at said second bottom wall.

11. The bathroom according to claim 3, further comprising a second technical compartment in a space between said first bottom wall and said second bottom wall, and an outer wall of the bathroom, said second technical compartment being accessible from the outside of the bathroom.

12. The bathroom according to claim 1, wherein the bathroom is a prefabricated module.

13. A structure for two cabins of a ship, the structure comprising a bathroom for two cabins according to claim 1.

14. The structure according to claim 1, wherein an outer perimeter of the structure is substantially rectangular, and comprises two major walls, and two minor walls, said bathroom being arranged at a first major wall of said two major walls of said outer perimeter of the structure, so that an outer wall of said bathroom corresponds to a central portion of said first major wall.

15. The structure according to claim 14, wherein on said first major wall, at sides of said outer wall of said bathroom, the following are arranged:

a first entrance for the first cabin, and a second entrance for the second cabin.

16. The structure according to claim 14, wherein at a second major wall of said two major walls, a first bed and a second bed are arranged so as to be substantially stuck at their longer side to said second major wall of the structure.

* * * * *